US005641267A

United States Patent [19]

Proctor et al.

[11] Patent Number: 5,641,267

[45] Date of Patent: Jun. 24, 1997

[54] CONTROLLED LEAKAGE SHROUD PANEL

[75] Inventors: Robert Proctor, West Chester; David R. Linger, Cincinnati; David A. Di Salle, West Chester; Steven R. Brassfield, Cincinnati; Larry W. Plemmons, Fairfield, all of Ohio

[73] Assignee: General Electric Company, Cincinnati, Ohio

[21] Appl. No.: 467,426

[22] Filed: Jun. 6, 1995

[51] Int. Cl.[6] ..... F01D 11/16

[52] U.S. Cl. ..... 415/173.1

[58] Field of Search ..... 415/173.1, 173.3

[56] References Cited

U.S. PATENT DOCUMENTS

| | | | |
|---|---|---|---|
| 4,101,242 | 7/1978 | Coplin et al. | 415/134 |
| 4,303,371 | 12/1981 | Eckert | 415/116 |
| 4,529,355 | 7/1985 | Wilkinson | 415/173.1 |
| 4,573,866 | 3/1986 | Sandy, Jr. et al. | 415/116 |
| 5,169,287 | 12/1992 | Proctor et al. | 415/115 |
| 5,174,714 | 12/1992 | Plemmons et al. | 415/177 |
| 5,188,506 | 2/1993 | Creevy et al. | 415/173.1 |
| 5,197,853 | 3/1993 | Creevy et al. | 415/173.1 |
| 5,205,708 | 4/1993 | Plemmons et al. | 415/173.1 X |
| 5,273,396 | 12/1993 | Albrecht et al. | 415/173.1 |
| 5,423,659 | 6/1995 | Thompson | 415/173.1 |

OTHER PUBLICATIONS

General Electric Company, CF34–3A1 gas turbine engine in production more than 1 year; 3 figures showing high pressure turbine shrouds and unpublished proposed temporary fix.

*Primary Examiner*—Edward K. Look
*Assistant Examiner*—Michael S. Lee
*Attorney, Agent, or Firm*—Andrew C. Hess; Wayne O. Traynham

[57] ABSTRACT

A shroud panel for a turbine shroud includes forward and aft hooks which are used to support the panel radially above a plurality of turbine rotor blades. The panel forward hook has radially outer and inner lands, with the outer land being defined by a plurality of pads circumferentially spaced apart from each other by a respective recess. The panel forward hook is sized to engage the complementary forward slot of the turbine shroud substantially concentrically therein. The pads and recess restrict flow leakage around the panel forward hook for maintaining backflow margin and improving clearance control.

12 Claims, 4 Drawing Sheets

CONTROLLED LEAKAGE SHROUD PANEL

CROSS REFERENCE TO RELATED APPLICATION

The present invention is related to concurrently filed patent application Ser. No. 08/467,437, filed Jun. 6, 1995, and entitled "SEALABLE TURBINE SHROUD HANGER".

BACKGROUND OF THE INVENTION

The present invention relates generally to gas turbine engines, and, specifically, to clearance control between turbine rotor blade tips and a stator shroud spaced radially thereabove.

A gas turbine engine includes in serial flow communication one or more compressors followed in turn by a combustor and high and low pressure turbines disposed axisymmetrically about a longitudinal axial centerline within an annular outer casing. During operation, the compressors are driven by the turbine and compress air which is mixed with the fuel and ignited in the combustor for generating hot combustion gases. The combustion gases flow downstream through the high and low pressure turbines which extract energy therefrom for driving the compressors and producing output power either as shaft power or thrust for powering an aircraft in flight, for example.

Each of the turbines includes one or more stages of rotor blades extending radially outwardly from respective rotor disks, with the blade tips being disposed closely adjacent to a turbine shroud supported from the casing. The tip clearance defined between the shroud and blade tips should be made as small as possible since the combustion gases flowing therethrough bypass the turbine blades and therefore provide no useful work. In practice, however, the tip clearance is typically sized larger than desirable since the rotor blades and turbine shroud expand and contract at different rates during the various operating modes of the engine.

The turbine shroud has substantially less mass than that of the rotor blades and disk and therefore responds at a greater rate of expansion and contraction due to temperature differences experienced during operation. Since the turbines are bathed in hot combustion gases during operation, they are typically cooled using compressor bleed air suitably channeled thereto. In an aircraft gas turbine engine for example, acceleration burst of the engine during takeoff provides compressor bleed air which is actually hotter than the metal temperature of the turbine shroud. Accordingly, the turbine shroud grows radially outwardly at a faster rate than that of the turbine blades which increases the tip clearance and in turn decreases engine efficiency. During a deceleration chop of the engine, the opposite occurs with the turbine shroud receiving compressor bleed air which is cooler than its metal temperature causing the turbine shroud to contract relatively quickly as compared to the turbine blades, which reduces the tip clearance.

Accordingly, the tip clearance is typically sized to ensure a minimum tip clearance during deceleration, for example, for preventing or reducing the likelihood of undesirable rubbing of the blade tips against the turbine shrouds.

The turbine shroud therefore directly affects overall efficiency or performance of the gas turbine engine due to the size of the tip clearance. The turbine shroud additionally affects performance of the engine since any compressor bleed air used for cooling the turbine shroud is therefore not used during the combustion process or the work expansion process by the turbine blades and is unavailable for producing useful work. Accordingly, it is desirable to reduce the amount of bleed air used in cooling the turbine shroud for maximizing the overall efficiency of the engine.

In order to better control turbine blade tip clearances, active clearance control systems are known in the art and are relatively complex for varying during operation the amount of compressor bleed air channeled to the turbine shroud. In this way the bleed air may be provided as required for minimizing the tip clearances, and the amount of bleed air may therefore be reduced. However, in order to minimize the complexity and cost of providing clearance control, typical turbine shrouds are unregulated in cooling the various components thereof.

Furthermore, in order to control the blade tip clearance, flow of the compressor bleed air through the turbine shroud must also be controlled. Uncontrolled leakage of the bleed air through the various Joints in the turbine shroud assembly directly affects heat transfer and therefore thermal performance of the shroud. And, uncontrolled leakage of the bleed air from the shroud cavity disposed directly above each of the shroud panels has an undesirable effect on backflow margin. Backflow margin is a conventional parameter which indicates the pressure gradient across the shroud panels with a higher pressure being desired above the panels relative to the pressure of the combustion gases which flow along the inner surfaces thereof. Unless the backflow margin is maintained at a suitable level, combustion gases could be undesirably ingested backwardly through the various cooling holes provided for discharging the bleed air through the panels. This could considerably shorten the useful life of the shroud panels during operation.

SUMMARY OF THE INVENTION

A shroud panel for a turbine shroud includes forward and aft hooks which are used to support the panel radially above a plurality of turbine rotor blades. The panel forward hook has radially outer and inner lands, with the outer land being defined by a plurality of pads circumferentially spaced apart from each other by a respective recess. The panel forward hook is sized to engage the complementary forward slot of the turbine shroud substantially concentrically therein. The pads and recess restrict flow leakage around the panel forward hook for maintaining backflow margin and improving clearance control.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
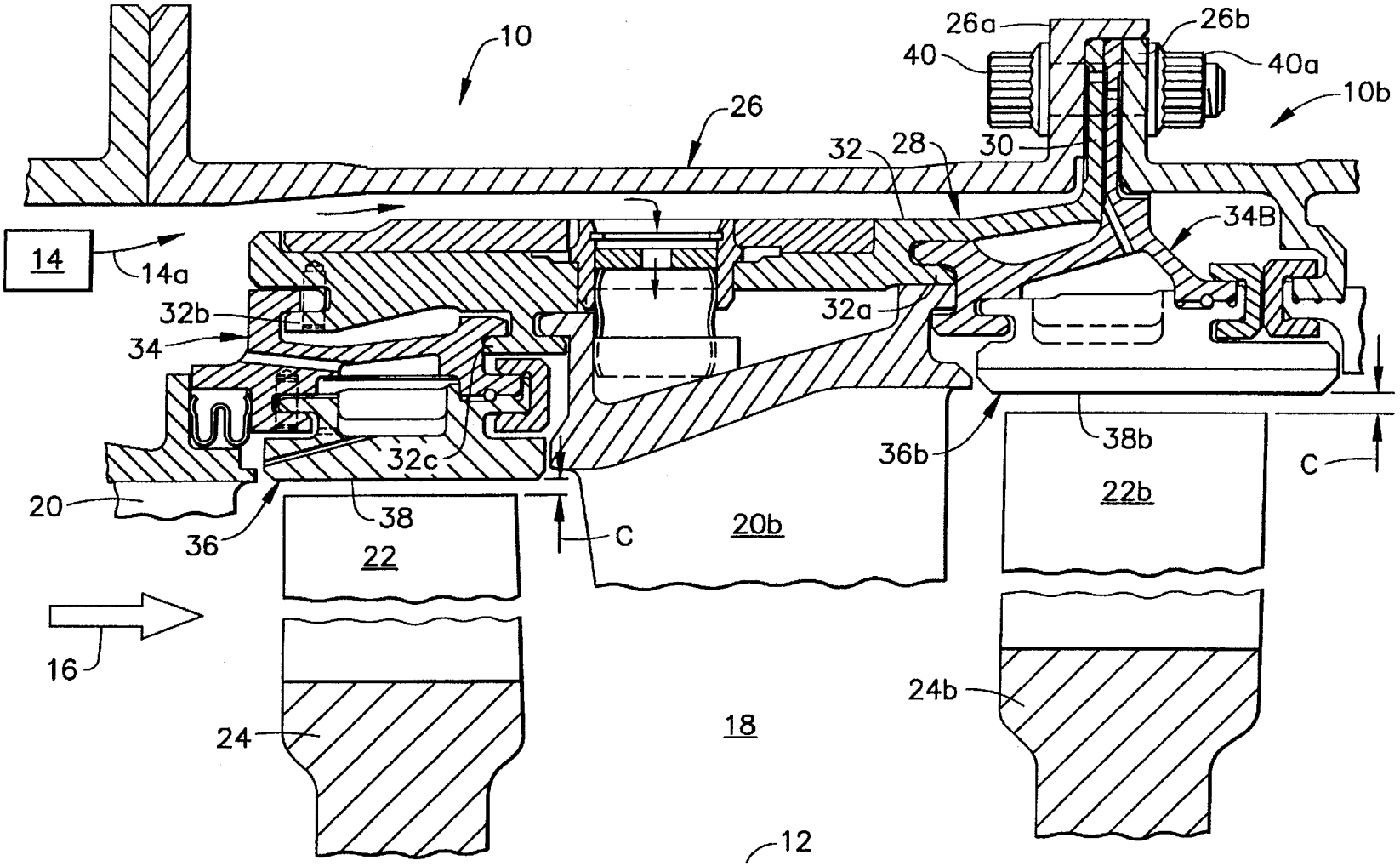
FIG. 1 is a partly sectional axial view through portions of axisymmetrical turbine shrouds in accordance with one embodiment of the present invention surrounding two stages of turbine rotor blades extending outwardly from respective rotor disks.

Illustrated in FIG. 1 is an exemplary embodiment of a pair of turbine shrouds 10, 10*b* which are axisymmetrical about an axial centerline axis 12 in an aircraft gas turbine engine. The aircraft engine also includes one or more conventional compressors one of which is represented schematically by the box 14, with compressed air being channeled to a conventional combustor (not shown) in which the air is mixed with fuel and ignited for generating hot combustion gases 16 which are discharged axially therefrom.

Disposed downstream from the combustor is a conventional high pressure turbine (HPT) 18 which receives the combustion gases 16 for extracting energy therefrom. In this exemplary embodiment, the HPT 18 includes at least two stages, with the first stage including the first stage turbine shroud 10 and the second stage including the second stage turbine shroud 10*b*. The first and second stages include conventional first and second stage stationary turbine nozzles 20, 20*b* each having a plurality of circumferentially spaced apart stator vanes extending radially between outer and inner annular bands. Disposed downstream from the nozzles 20, 20*b* are respective pluralities of circumferentially spaced apart first and second stage turbine rotor blades 22, 22*b* extending radially outwardly from first and second stage rotor disks 24, 24*b* axisymmetrically around the centerline axis 12.

The first stage turbine shroud 10 illustrated in FIG. 1 is an assembly including a corresponding portion of an annular outer stator casing 26 which provides a stationary support for the several components thereof. The outer casing 26 is axially split at a pair of adjacent first and second radial flanges 26*a* and 26*b* which complement each other and are formed as respective integral ends of the casing 26 at the splitline. An annular, one-piece shroud ring or support 28 is suspended from the casing first and second flanges 26*a,b* and is used in both the first and second stage shrouds 10, 10*b*, as well as supports the second stage nozzle 20*b*. The shroud support 28 is generally L-shaped in transverse section and has an annular radial support flange 30 and an integral annular forward support leg 32 which extends axially forwardly from a radially inner end of the support flange 30. The forward support leg 32 extends axially forwardly for supporting respective components of both the first and second stage turbine shrouds and the nozzle 20*b*.

An annular, multi-segmented first stage shroud hanger 34 is suspended from the forward, free distal end of the support 28. An annular one-piece second stage shroud ring or hanger 34B is also suspended from the aft end of the support 28 at the casing first and second flanges 26*a,b* and is disposed with the shroud support 28 coaxially about the centerline axis 12. The second stage shroud hanger 34*b* is generally Y-shaped in transverse section and has an annular radial hanger flange, and integral annular forward and aft hanger legs at a radially inner end thereof. The forward and aft legs extend axially oppositely to each other, with the forward leg having a forward hook being conventionally supported on a corresponding aft hook 32*a* of the forward support leg 32. The first stage shroud hanger 34 is generally H-shaped in transverse section with radially outer or top forward and aft hooks 34*a*, 34*b* being conventionally supported on a corresponding pair of forward hooks 32*b* and 32*c* at the distal forward end of the support leg 32.

A plurality of arcuate first stage shroud panels 36 are removably fixedly joined to the inner forward hanger hooks 34*c*, 34*d* by corresponding hooks. And, a plurality of arcuate second stage shroud panels 36*b* are removably fixedly joined to the second stage shroud hanger 34*b*. Each panel 36, 36*b* includes a radially inner surface 38, 38*b* which is positionable radially above tips of the respective first and second stage rotor blades 22, 22*b* to define respective tip clearances C therebetween.

The support flange 30 and the second stage hanger radial flange are axially positioned or sandwiched between the first and second casing flanges 26*a,b* in abutting or sealing contact with each other, with all four flanges having a plurality of circumferentially spaced apart, axially extending common or aligned bolt holes, with each bolt hole receiving a respective bolt 40 (and complementary nut 40*a*) for axially clamping together the four flanges to support the first and second stage shrouds 10, 10*b* and the second stage nozzle 20*b* from the casing 26.

As shown in FIG. 1, the forward leg 32 of the common shroud support 28 extends generally axially and parallel to the casing 26 and is spaced radially inwardly therefrom to define an annular flow channel or duct for axially receiving compressor bleed air 14*a* from the compressor 14.

The bleed air 14*a* is suitably channeled to both first and second stage shrouds 10, 10*b* and the second stage nozzle 20*b* for providing cooling thereof against the heating caused by the hot combustion gases 16 during operation. Since all of these components are cantilevered or suspended from the outer casing 26 at the common casing flanges 26*a,b* they thermally expand and contract at relatively faster rates than that of the relatively slower responding, higher mass rotor blades 22, 22*b* and their respective rotor disks 24, 24*b*. Accordingly, the respective tip clearances C vary in size during operation.

Since both turbine shrouds 10, 10*b* are assemblies of various components, the various joints therebetween are subject to undesirable leakage of the bleed air 14*a*. Uncontrolled leakage of the bleed air affects the thermal response of the turbine shroud component and in turn affects the tip clearances C. Bleed air leakage also affects the backflow margin of the shroud panels 36, 36*b*. Where leakage cannot be controlled, the amount of parasitic bleed air channeled through the shrouds must be suitably increased for obtaining affective thermal response of the shrouds and maintaining acceptable backflow margin notwithstanding bleed air leakage. This decreases overall efficiency of the engine and is undesirable. Furthermore, typical sealing arrangements require separate components such as leaf seals, spline seals, or W-seals which undesirably increase the number of parts and the resulting manufacturing and assembly costs.

Figure 2:
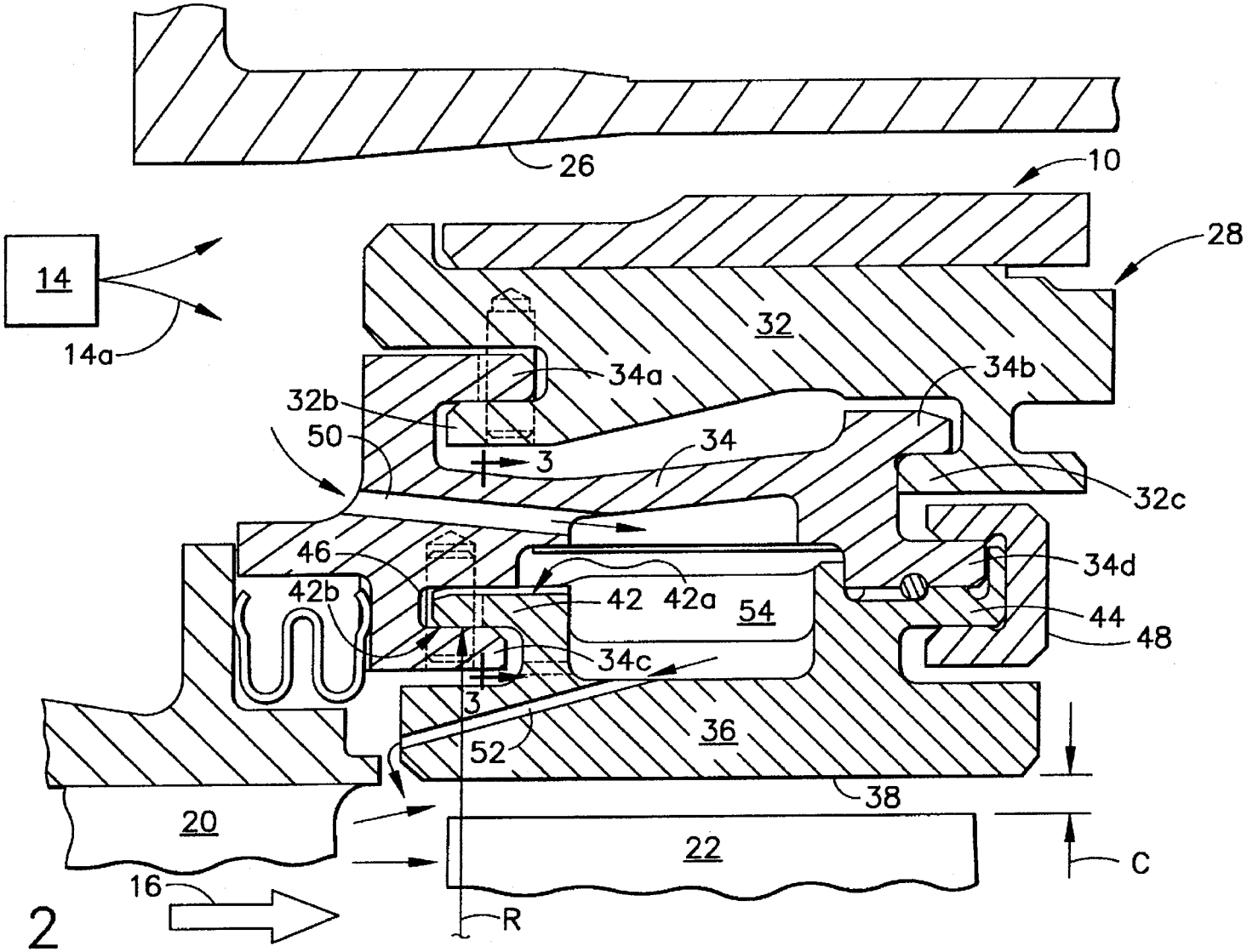
FIG. 2 is an enlarged view of the first stage turbine shroud illustrated in FIG. 1 showing in more detail turbine shroud panels supported by a hanger over first stage turbine blades.

FIG. 2 illustrates in more particularity the first stage turbine shroud 10 configured in accordance with one embodiment of the present invention for reducing or controlling bleed air leakage from the shroud panels 36, with the invention being similarly applied to the second stage turbine shroud 10*b* although not separately further described herein in view of the similarity of features in the first and second stage turbine shrouds 10, 10*b*.

As shown in FIG. 2, the shroud panel 36 includes on its radially outer side an axially forward hook 42 and an aft hook 44 spaced axially aft therefrom. The forward hook 42 extends axially forwardly for mounting the forward end of the panel 36 into a complementary forward slot 46 defined by an axially aft extending forward inner hook 34*c* of the first stage turbine shroud hanger 34. The panel aft hook 44 extends axially aft for mounting the aft end of the panel 36 to a complementary aft inner hook 34*d* of the first stage turbine shroud hanger 34 in a conventional manner using a conventional C-clip 48. The basic arrangement of the panel 36 including its forward and aft hooks 42, 44 is conventionally known wherein the forward hook 42 is locked into engagement with the hanger forward slot 46 as the panel aft hook 44 is assembled radially upwardly to contact the hanger aft hook 34*d*. The C-clip 48 is then installed over the panel and hanger aft hooks 44, 34*d* to retain the panel 36 to the hanger 34.

The panel aft hook 44 is sealingly joined to the hanger aft hook 34*d* in a conventional manner for controlling undesirable leakage therebetween, and is not the subject of the present invention. Since the panel forward hook 42 must be locked into its final position in the hanger forward slot 46, suitable manufacturing tolerances are required therebetween to enable assembly thereof without unacceptable interference therebetween. Manufacturing tolerances in prior art conventional designs result in undesirable leakage flowpaths around the panel forward hook 42. To accommodate this leakage in prior art designs, additional parasitic bleed air flow is required for ensuring acceptable backflow margin. However, leakage around the panel forward hook 42 undesirably increases the thermal response of that component which adversely affects the blade tip clearance C.

More specifically, and referring again to FIG. 2, the hanger 34 includes a plurality of circumferentially spaced apart inlet apertures 50 extending axially therethrough radially above the hanger inner forward hook 34*c* and radially below the hanger outer forward hook 34*a* from the forward face of the hanger 34 into its center region. The inlet apertures 50 carry a portion of the bleed air 14*a* axially aft through the forward portion of the hanger 34 to the center region. Each of the panels 36 includes a plurality of circumferentially spaced apart outlet or purge apertures 52 extending through the leading edge thereof below the panel forward hook 42. The panel outlet apertures 52 are representative of the various outlet apertures which may extend through the panel 36 for providing effective cooling thereof, with the spent bleed air then being channeled into the combustion gas flowpath below the panels 36.

The panel 36 is spaced radially inwardly from the center region of the hanger 34 to define an enclosed shroud cavity 54 radially therebetween and axially between the panel forward and aft hooks 42, 44 and between the hanger inner forward and aft hooks 34*c*, 34*d*. The shroud cavity 54 is supplied by the bleed air from the inlet apertures 50 to effect a positive pressure or backflow margin across the panel outlet apertures 52. The pressure of the bleed air in the shroud cavity 54 should be suitably greater than the pressure of the combustion gases 16 which flow radially inwardly of the shroud panels 36 for maintaining a suitable backflow margin to prevent ingestion of the combustion gases 16 backwardly through the outlet apertures 52 and into the shroud cavity 54. Such backward ingestion is undesirable since it would heat the shroud panels 36 and significantly reduce the useful life thereof.

Figure 3:
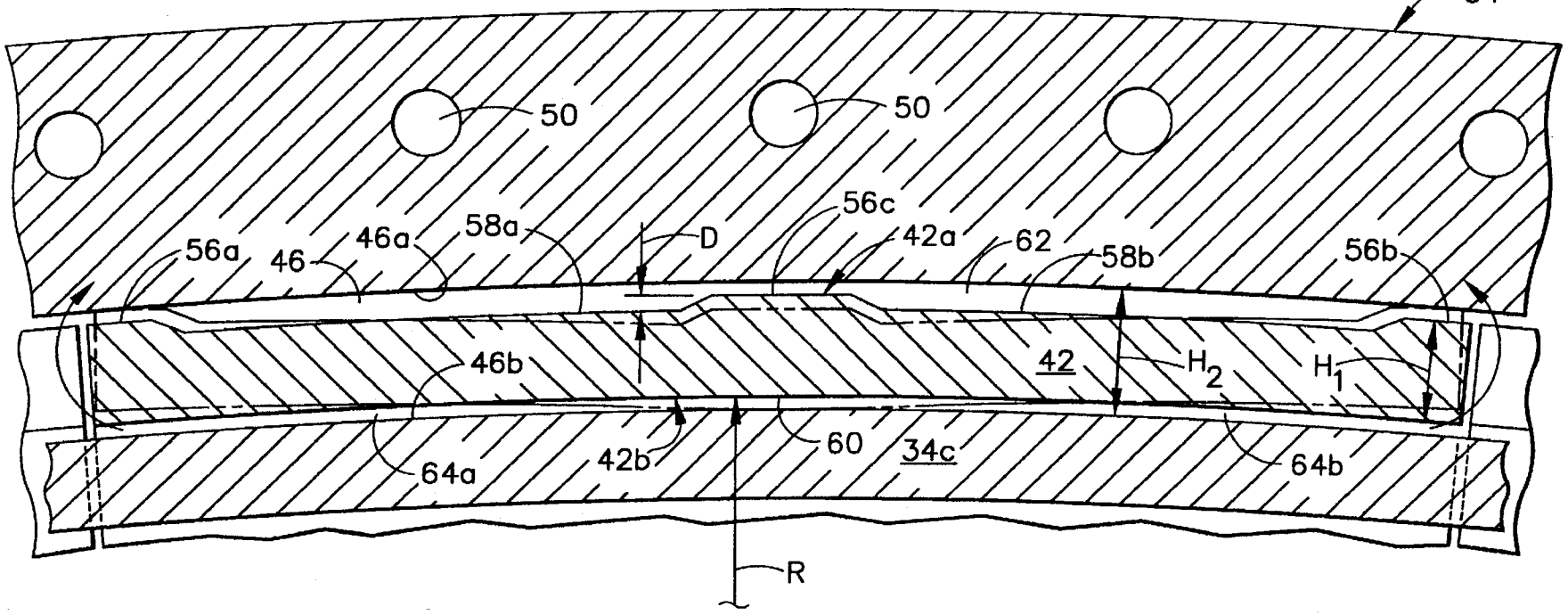
FIG. 3 is a forward-facing-aft sectional view of a forward hook of one of the shroud panels illustrated in FIG. 2 disposed in a complementary forward slot of the hanger with clearances therebetween being greatly exaggerated for emphasis, and taken along line 3—3.
Figure 4:
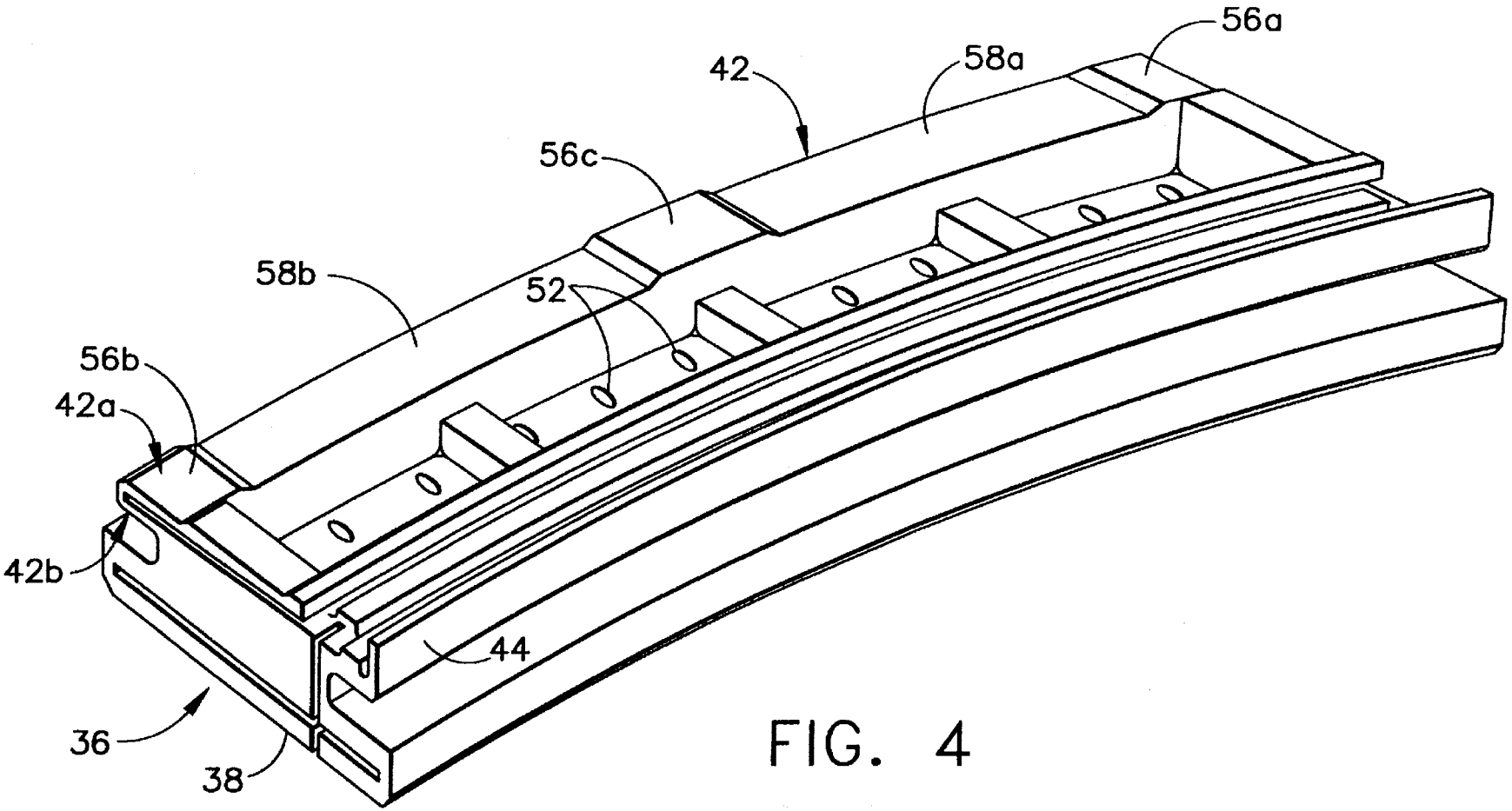
FIG. 4 is an aft-facing-forward perspective view of an exemplary one of the first stage shroud panels illustrated in FIGS. 1–3 showing in more particularity the forward hook thereof including a plurality of pads and respective recesses disposed circumferentially therebetween.

In order to control or restrict leakage of the bleed air 14*a* from the shroud cavity 54 around the panel forward hook 42, the panel forward hook 42 is suitably configured in accordance with one embodiment of the present invention as illustrated in FIGS. 3 and 4. FIG. 3 is a forward-facing-aft elevational sectional view through a portion of the panel forward hook 42 disposed in the hanger inner forward slot 46, with the clearances therebetween being greatly exaggerated for emphasis. It is a major objective of the present invention to reduce the radial clearance between the panel forward hook 42 in its corresponding hanger forward slot 46 to as small as possible for restricting leakage of the bleed air 14*a* therethrough while at the same time allowing assembly of the forward hook 42 in the forward slot 46 without binding interference which would prevent the assembly thereof.

The panel forward hook 42 is defined by and has radially outer and inner lands 42*a*, 42*b* which are generally concentric with corresponding radially outer and inner lands 46*a*, 46*b* of the hanger inner forward slot 46. As shown in FIG. 3, the outer land 46*a* of the forward slot 46 is spaced radially above the outer land 42*a* of the forward hook 42. The inner land 46*b* of the forward slot 46, which is the outer surface of the hanger inner forward hook 34*c*, is disposed radially below the inner land 42*b* of the panel forward hook 42. In conventional prior art practice, the four outer and inner lands 42*a,b* and 46*a,b* of the panel forward hook 42 and the hanger forward slot 46 would all be smooth or uniform both circumferentially and axially and concentric with each other. Since the panels 36, including the forward hooks 42 thereof, are circumferentially arcuate, a suitable radial clearance must be provided between the forward hook 42 and its mating slot 46 to allow rocking assembly of the panel forward hook 42 into the hanger forward slot 46. It is well known that the radial dimensions of the forward hook 42 and the forward slot 46 are each separately subject to plus or minus manufacturing tolerances. If the tolerances are too small, it is statistically possible that the forward hook 42 cannot be inserted into the forward slot 46 due to binding interference therebetween at random circumferential locations. Accordingly, conventional prior art practice requires a suitably large manufacturing tolerance to enable assembly of these components without interference, with the resulting manufacturing tolerances necessarily providing an undesirable leakage flowpath around the panel forward hooks 42.

In order to decrease the flow area of the leakage paths around the panel forward hook 42, while still ensuring the ability to assemble the panel forward hook 42 into the hanger forward slot 46 without interference or binding, the outer land 42*a* of the panel forward hook 42 is specifically configured as shown in FIGS. 3 and 4 in accordance with one embodiment of the present invention. The outer land 42*a* is defined by a plurality of, in this case three, pads 56*a*, 56*b*, 56*c* extending circumferentially inwardly from opposite distal ends of each panel 36, and at the center thereof, which are circumferentially spaced apart completely from each other by a respective scallop or recess 58*a*, 58*b* extending circumferentially therebetween. As shown in FIGS. 3 and 4, the outer land 42*a* which forms the tops of the pads 56*a–c* is preferably machined at a common radius relative to the centerline axis 12 (see FIG. 1) of the engine, with each of the pads 56*a–c* being circumferentially arcuate and smooth or uniform. From the nominal radius of the outer land 42*a*, each of the recesses 58*a,b* has preferably the same radial depth D, with the recesses 58*a,b* extending the full axial extent of the panel forward hook 42 and completely circumferentially separating the pads 56*a–c* from each other.

Adjoining panels 36 are assembled together to form a complete 360° ring. Each of the panels 36 is arcuate, with the inner land 42*b* of the panel forward hook 42 having a nominal radius R from the engine centerline as shown in FIG. 1. The corresponding radius of the inner land 46*b* of the hanger forward slot 46 is initially equal to the cold radius R of the panel forward hook 42. Accordingly, the panel 42 is sized in radius to engage the complementary hanger forward slot 46 substantially concentrically therein. In this way, the discrete pads 56 *a,b,c* provide fewer potential assembly interference sites in the forward slot 46 which allows for a significant reduction in required manufacturing tolerances, and a corresponding reduction in leakage flow area which improves performance of the turbine shroud 10.

More specifically, referring again to FIG. 3, each of the pads 56*a–c* has a common radial height $H_1$ measured between the outer and inner lands 42*a,b* which is predeterminedly sized relative to a corresponding radial height $H_2$ of the hanger forward slot 46 to minimize radial clearance therebetween for in turn minimizing leakage therethrough of the compressor bleed air 14*a*, while still allowing assembly of the panel forward hook 42 into the hanger forward slot 46 without undesirable interference. In one embodiment, only the two first and second pads 56*a,b* disposed at the circumferentially opposite ends of the panel forward hook 42*a* are used. In the embodiment illustrated in FIG. 3, the third pad 56*c* is used and is disposed equidistantly between the first and second pads 56*a,b* to additionally reduce the leakage flow area therebetween if desired.

By introducing the discrete, circumferentially separated pads 56*a–c* with the shallow recesses 58*a,b* therebetween, the number of potential interference sites between the panel forward hook 42 and the hanger forward slot 46 is reduced substantially. Interference sites at any location along the circumference of a prior art uniform forward hook are reduced to the specific number provided by the pads themselves, for example three potential interference sites as illustrated in FIG. 3. Potential interference sites between the respective pads 56*a–c* within the area of the respective recesses 58*a,b* are therefore completely eliminated. Accordingly, the radial height $H_1$ of the panel forward hook 42 at each of the pads 56*a–c* may be made larger than it otherwise would for a given radial height $H_2$ of the hanger forward slot 46. This significantly decreases leakage without causing assembly binding. Since the panel forward hook 42 having the pads 56*a–c* is less susceptible to interference or binding during assembly, the radial height $H_1$ may be increased with its attendant manufacturing tolerances for providing shroud panels 36 having a comparable statistical ability to be assembled without interference. Furthermore, improved, state-of-the-art manufacturing equipment may be used for further decreasing the required manufacturing tolerances to increase the radial height $H_1$ which in turn further reduces the leakage flowpath area between the forward hook 42 and the hanger forward slot 46.

Reducing leakage around the forward hook 42 in turn reduces the heat transfer in this vicinity which decreases the thermal response time of the hooks. This in turn improves the tip clearance C during transient operation of the engine. Reducing the bleed air leakage around the panel forward hook 42 also reduces the pressure reduction within the shroud cavity 54 which in turn better maintains the backflow margin of the bleed air 14*a* within the shroud cavity 54. And, reduced leakage around the panel forward hook 42 also reduces parasitic losses, which in turn decrease the overall amount of bleed air required for cooling the turbine shroud 10 further improving performance of the engine.

As shown in FIGS. 3 and 4, the third pad 56*c* is preferably disposed circumferentially equidistantly between the first and second pads 56*a,b*, with the first recess 58*a* being disposed between the first and third pads 56*a,c*, and the second recess 58*b* being disposed between the second and third pads 56*b,c*. The introduction of the third pad 56*c* itself correspondingly reduces the leakage flow area between the first and second pads 56*a,b* without undesirably increasing the potential for interference of the pads in the hanger forward slot 46 during assembly therein.

Furthermore, by positioning the first and second pads 56*a,b* at circumferentially opposite ends of the panel 36, they will be first to contact the outer land 46*a* of the hanger forward slot 46 upon transient thermal expansion of the panel 36 as it heats up during operation. Since the first and second pads 56*a,b* are radially higher than the recesses 58*a,b* therebetween, the first and second pads 56*a,b* minimize radial travel of the panel forward hook 42 in the hanger forward slot 46. FIG. 3 illustrates in phantom the transient thermal expansion of one of the forward hooks 42 which tends to straighten out in the circumferential direction relative to its arcuate cold shape, with the circumferentially opposite distal ends of the hook 42 rolling outwardly relative to the center of the hook 42 as indicated by the clockwise and counterclockwise movement arrows. Reduced thermal distortion reduces leakage between the inner lands 42*b* and 46*b*.

Although the outer land 42*b* of the panel forward hook 42 is interrupted by the recesses 58*a,b*, the inner land 42*b* of the panel forward hook 42 is preferably smooth or uniform and includes a center region 60 as shown in FIG. 3. Upon transient thermal expansion of the panel 42 during operation, the first and second pads 56*a,b* will be first to contact the outer land 46*a* of the hanger forward slot 46 as indicated above which defines an outer flow restriction channel 62 therebetween. The center region 60 of the inner land 42*b* of the forward hook 42 correspondingly contacts the inner land 46*b* of the hanger forward slot 46 to define a pair of generally equal inner flow restriction channels 64*a,b* therebetween. Although both outer and inner channels 62 and 64*a,b* are formed during thermal distortion of the panel 42, the flow area of such channels is smaller than would otherwise occur without the use of the discrete pads 56*a–c* since the hook thickness $H_1$ is larger. The reduced flow area of the channels 62, 64*a,b* reduces leakage of the bleed air around the panel forward hook 42 as discussed above for improving overall performance.

And, the outer and inner flow channels 62, 64*a,b* may be advantageously used for providing in-series flow restrictions for predeterminedly metering leakage of the bleed air 14*a* from the shroud cavity 54 (see FIG. 2). Since the discrete first and second pads 56*a,b* are provided, transient thermal distortion of the panel 42 will necessarily result in the predetermined contact areas illustrated in FIG. 3 with the flow areas associated with the outer and inner channels 62, 64*a,b* being in turn predetermined or known which may be used to advantage in metering the flow leakage. By metering the flow leakage from the shroud cavity 54, the backflow margin therein may also be controlled. Since the bleed air leakage through the panel forward hook 42 may now have a predetermined, known value, reduction in backflow margin in the shroud panel 54 will no longer occur due to leakage past the forward hook 42.

In the exemplary embodiment illustrated in FIG. 3, the panel forward hook 42 is sized so that the flow area of the outer flow restriction channel 62 is substantially equal to the collective flow area of the inner flow restriction channels 64*a,b*, with either of the outer or inner channels 62, 64*a,b* then providing a known metering function. The panel forward hook 42 may be otherwise sized if desired so that the outer leakage area is greater than the inner leakage area or vice versa.

Accordingly, the introduction of the discrete pads 56*a–c* and their separating recesses 58*a,b* provide effective passive regulation or clearance control of the bleed air leakage over the panel forward hook 42. Decreased bleed air leakage is attainable with existing or reduced manufacturing tolerances of the forward hook 42 by making it larger, without resulting in undesirable interference between the forward hook 42 and the hanger forward slot 46 during assembly. Improved tip clearance control is obtained while also obtaining improved backflow margin in the shroud cavity 54.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A shroud panel for a turbine shroud positionable radially above a plurality of turbine rotor blades comprising:

a panel forward hook extending axially for mounting said panel to a complementary forward slot of a component of said turbine shroud;

a panel aft hook spaced axially from said panel forward hook and extending axially for mounting said panel to a complementary aft hook of said turbine shroud;

said panel forward hook having oppositely facing radially outer and inner lands, said outer land being defined by a plurality of pads circumferentially spaced apart from each other by a respective recess, with said pads and recess being disposed coextensively over said inner land; and said panel, including said panel forward hook, being arcuate in a circumferential direction, with said panel forward hook being sized to engage said forward slot substantially concentrically therein.

2. A panel according to claim 1 wherein said pads have a radial height predeterminedly sized relative to a radial height of said forward slot to minimize radial clearance therebetween for minimizing leakage therethrough of compressor bleed sir while allowing assembly of said panel forward hook into said slot without interference.

3. A panel according to claim 2 wherein said pads comprise first and second pads disposed at circumferentially opposite ends of said panel to first contact said forward slot upon thermal expansion of said panel for minimizing radial travel of said panel forward hook in said forward slot.

4. A panel according to claim 3 further comprising a third pad spaced circumferentially between said first and second pads, with a first recess being disposed between said first and third pads and a second recess being disposed between said second and third pads.

5. A panel according to claim 3 in combination with an annular outer casing and a hanger fixedly joined to said outer casing to define said turbine shroud and wherein:

said hanger includes said forward slot supporting said panel forward hook, and also includes said turbine shroud aft hook defining a hanger aft hook supporting said panel aft hook, and said hanger further includes a plurality of axial inlet apertures extending therethrough radially above said hanger forward slot for channeling said bleed air;

said panel includes a plurality of outlet apertures therethrough, and is spaced radially inwardly from said hanger to define a shroud cavity therebetween supplied by said bleed air from said inlet apertures to effect a pressure backflow margin across said outlet apertures; and said panel forward hook is sized to minimize radial clearance with said cooperating hanger forward slot for minimizing leakage of said bleed air therethrough from said shroud cavity to in turn maintain said backflow margin.

6. A turbine shroud positionable radially above a plurality of turbine rotor blades comprising:

an annular outer casing;

a hanger fixedly joined to said outer casing and including a hanger forward slot and a hanger aft hook;

a shroud panel including:

a panel forward hook extending axially to engage said hanger forward slot;

a panel aft hook spaced axially from said panel forward hook and extending axially to engage said hanger aft hook;

said panel forward hook having radially outer and inner lands, said outer land being defined by a plurality of pads circumferentially spaced apart from each other by a respective recess; and said panel, including said panel forward hook, being arcuate in a circumferential direction, with said panel forward hook being sized to engage said hanger forward slot substantially concentrically therein; and wherein said pads have a radial height predeterminedly sized relative to a radial height of said hanger forward slot to minimize radial clearance therebetween for minimizing leakage therethrough of compressor bleed air while allowing assembly of said panel forward hook into said hanger forward slot without interference.

7. A turbine shroud according to claim 6 wherein said pads comprise first and second pads disposed at circumferentially opposite ends of said panel to first contact said hanger forward slot upon thermal expansion of said panel for minimizing radial travel of said panel forward hook in said hanger forward slot.

8. A turbine shroud according to claim 7 further comprising a third pad spaced circumferentially between said first and second pads, with a first recess being disposed between said first and third pads and a second recess being disposed between said second and third pads.

9. A turbine shroud according to claim 7 wherein:

said hanger further includes a plurality of axial inlet apertures extending therethrough radially above said hanger forward slot for channeling said bleed air;

said panel includes a plurality of outlet apertures therethrough, and is spaced radially inwardly from said hanger to define a shroud cavity therebetween supplied by said bleed air from said inlet apertures to effect a pressure backflow margin across said outlet apertures; and said panel forward hook is sized to minimize radial clearance with said cooperating hanger forward slot for minimizing leakage of said bleed air therethrough from said shroud cavity to in turn maintain said backflow margin.

10. A turbine shroud according to claim 9 wherein:

said hanger forward slot is defined by a hanger forward hook extending axially aft and includes a radially outer land spaced from a radially inner land comprising the outer surface of said hanger forward hook, said outer and inner lands of said hanger forward slot being uniform; and said inner land of said panel forward hook is uniform and includes a center region;

said first and second pads contact said outer land of said hanger forward slot upon said thermal expansion to define an outer flow restriction channel therebetween, and said center region of said panel forward hook correspondingly contacts said inner land of said hanger forward slot to define a pair of inner flow restriction channels therebetween.

11. A turbine shroud according to claim 10 wherein said panel forward hook is sized so that said outer and inner flow restriction channels have predetermined flow areas for metering leakage flow of said bleed air therethrough from said shroud cavity to control said backflow margin therein.

12. A turbine shroud according to claim 11 wherein said panel forward hook is sized so that said flow area of said outer flow restriction channel is substantially equal to a collective flow area of said inner flow restriction channels.

* * * * *